US010876357B2

(12) United States Patent
Schönig et al.

(10) Patent No.: US 10,876,357 B2
(45) Date of Patent: Dec. 29, 2020

(54) FLOWING DRILLING APPARATUS AND FLOW DRILLING PROCESS

(71) Applicant: Weber Schraubautomaten GmbH, Wolfratshausen (DE)

(72) Inventors: Christian Schönig, Penzberg (DE); Jochen Hartmann, Bad Tölz (DE)

(73) Assignee: Weber Schraubautomaten GmbH

( * ) Notice: Subject to any disclaimer, the term of this patent is extended or adjusted under 35 U.S.C. 154(b) by 0 days.

(21) Appl. No.: 16/365,280

(22) Filed: Mar. 26, 2019

(65) Prior Publication Data

US 2020/0308912 A1 Oct. 1, 2020

(51) Int. Cl.
*E21B 4/02* (2006.01)
*E21B 47/20* (2012.01)

(52) U.S. Cl.
CPC ..... *E21B 4/02* (2013.01); *E21B 47/20* (2020.05)

(58) Field of Classification Search
CPC ..... E21B 4/02; E21B 47/182
See application file for complete search history.

(56) References Cited

U.S. PATENT DOCUMENTS

2001/0050186 A1* 12/2001 Wilson ..... B23Q 11/0046 175/38
2011/0192612 A1* 8/2011 Swietlik ..... E21B 17/06 166/373
2012/0217067 A1* 8/2012 Mebane, III ..... E21B 44/02 175/57

FOREIGN PATENT DOCUMENTS

DE 102010006406 A1 8/2011
DE 102010032438 A1 2/2012

* cited by examiner

*Primary Examiner* — Amine Benlagsir
(74) *Attorney, Agent, or Firm* — Dickinson Wright PLLC

(57) ABSTRACT

A flowing drilling apparatus having a feed drive for producing a feed of a flow drill in an axial direction and having a rotary drive for producing a rotational movement of the flow drill. The flowing drilling apparatus includes a control device that is configured and adapted to control the feed drive and/or the rotary drive in accordance with a first set of parameters up to a defined switchover point and to control it/them in accordance with a second set of parameters differing from the first set of parameters, from the defined switchover point onward.

20 Claims, 7 Drawing Sheets

FLOWING DRILLING APPARATUS AND FLOW DRILLING PROCESS

Figure 1:
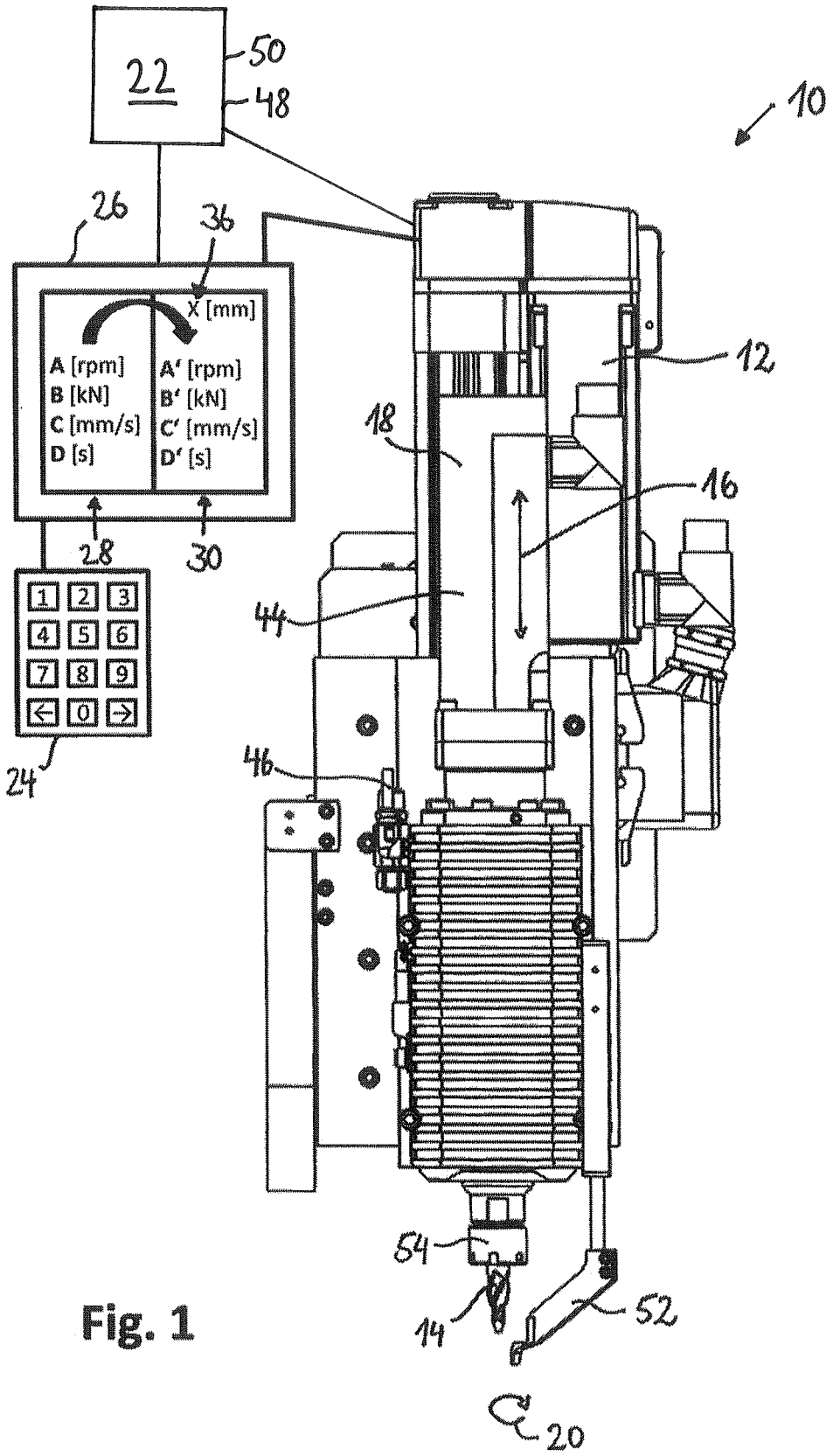

The present invention relates to a flowing drilling apparatus having a feed drive for producing a feed of a flow drill in an axial direction and having a rotary drive for producing a rotational movement of the flow drill.

Flow drilling is a special drilling process in which bores are formed in a non-cutting process by plasticizing the material. First, a rotating flow drill is placed onto a workpiece to be machined and a force is applied to it in an axial direction. The workpiece is heated by the friction produced between the flow drill and the workpiece. As soon as the workpiece has sufficiently plasticized locally, the flow drill penetrates through the metal sheet and forms a passage in so doing. The material displaced on the shaping of the passage forms a bead at the upper side and at the lower side of the workpiece.

Flow drilling is typically used to produce a bore in a meal sheet when the bore should subsequently be provided with a thread. For the bead produced by the displacement of the plasticized material provides that a thickness of the metal sheet in the region of the bore is made larger so that an internal thread having a plurality of turns can be cut into the bore.

To plasticize the material of the workpiece or of the metal sheet as fast as possible during flow drilling, i.e. to locally heat the metal sheet to approximately 600° C., a high rotational speed and a high feed force of the flow drill is necessary. On the other hand, it would be better for a high surface quality of the passage if the passage is produced at a lower rotational speed and feed force. With known flowing drilling apparatus, a compromise thus has to be found for the rotational speed and for the feed force so that the material is plasticized as fast as possible but so that, on the other hand, the surface quality of the passage is sufficiently high.

It is an object of the present invention to provide a flowing drilling apparatus that can drill a flow drilling hole particularly fast and in so doing produces a passage having a high surface quality.

The object is satisfied by a flowing drilling apparatus having the features of claim 1 and in particular in that a control device is provided that is configured and adapted to control the feed drive and/or the rotary drive up to a defined switchover point in accordance with a first set of parameters and to control it/them from the defined switchover point onward in accordance with a second set of parameters differing from the first set of parameters, in particular with respect to its values.

It is possible due to the option of operating the flowing drilling apparatus in accordance with different sets of parameters, i.e. in different operating modes, between which the flowing drilling apparatus is switched over, in particular automatically, at the switchover point, to drive the flow drill with a higher axial force and at a higher rotational speed until the sheet metal material is plasticized and subsequently to carry out a shaping of the passage with a smaller axial force and at a lower rotational speed. A better surface quality is thus reached on the shaping of the passage in comparison with known flowing drilling apparatus. It is possible due to the better surface quality of the passage to improve the quality of a subsequently shaped thread.

Advantageous embodiments of the invention can be seen from the dependent claims, from the description and from the drawings.

In accordance with an advantageous aspect of the invention, an input device is provided by means of which the first set of parameters can be input. Alternatively or additionally, the second set of parameters can be able to be input into the input device. A user can hereby set the parameters, for example a rotational speed of the flow drill or a feed force of the flow drill, to a specific sheet metal material having a specific sheet metal thickness. The flowing drilling apparatus can hereby be adapted to a wide spectrum of sheet metal materials and sheet metal thicknesses.

To intuitively configure an input of the parameters for the user, the input device can comprise an input mask of a computer program into which the user can input the parameters. Alternatively or additionally, the flowing drilling apparatus can determine the sheet metal material and its sheet metal thickness automatically, for example by means of optical sensors, and can automatically set corresponding parameters, i.e. operating parameters, of the flowing drilling apparatus.

In accordance with a further advantageous aspect, geometrical data of the flow drill can be input by the input device. For example, boxes for the length of the flow drill and/or for its diameter can be provided in the input mask of the computer program. Alternatively or additionally, sensors can be provided that automatically detect geometrical data of the flow drill and provided them to the control device.

In accordance with an advantageous aspect, the switchover point can be able to be input by means of the input device. The switchover point is preferably defined by a value of a measured variable. A defined feed path of the flow drill in the axial direction relative to a workpiece surface arranged perpendicular to the axial direction preferably serves as the switchover point.

So that the user can check the set operating parameters, a display device can be provided by means of which the first set of parameters and/or the second set of parameters is/are displayable to a user. If, for example, the flowing drilling apparatus itself determines the parameters, the user can check whether the parameters were correctly determined by means of the display apparatus. If the user has input the parameters, he can check his input by means of the display device.

The display device can be configured as a display. The display is preferably attached to the flowing drilling apparatus so that the user can check the input or the determination of the parameters without any great effort. The switchover point can additionally be displayable on the display device. Displayable means that the parameters or the switchover point are/is displayed on request or always before or during the operation of the apparatus.

In accordance with an embodiment that is particularly intuitive to operate, the input device can be integrated in the display device, e.g. by means of a touch display.

In accordance with a preferred aspect, the control device is connected to a measurement device, in particular to a sensor, that monitors one of the parameters of the first set of parameters and/or one of the parameters of the second set of parameters and continuously transmits the result to the control device. At least two separate measurement devices, in particular two separate sensors, are preferably provided for the monitoring of a respective parameter of the first set of parameters and/or of the second set of parameters. These two separate measurement devices are preferably likewise connected to the control device. The measurement devices can continuously provide data with respect to the parameters to the control device so that the control device can regulate the parameters to a first value in a first operating mode and to a second value after the switchover point.

In accordance with an advantageous aspect, a feed path measurement device is provided that is connected to the control device. The feed path measurement device can be configured as a differential movement measurement system, for example. The differential movement measurement system can determine a position of a workpiece to be machined by a stylus or contactlessly and can hereby determine the spacing between a tip of the flow drill and the workpiece in the axial direction. As soon as the tip of the flow drill has entered into the workpiece, the differential movement measurement system correspondingly measures a penetration depth of the tip of the flow drill, that is so-to-say a negative distance between the tip of the flow drill and the workpiece.

In accordance with a preferred aspect, the control device is configured and adapted to control the rotational speed of the rotary drive. In other words, the rotary drive can be controllable to a first rotational speed and can be controllable, from the switchover point onward, to a second rotational speed differing from the first rotational speed. An algorithm is thus stored in the control device by which the rotational speed of the rotary drive can be controlled to different values. Rotational speeds of up to 12,000 r.p.m. are preferably settable.

In accordance with an advantageous aspect, a rotational speed measurement device is provided that is connected to the control device. The rotational speed measurement device is preferably integrated in the rotary drive. The rotational speed measurement device can be configured and adapted to measure the rotational speed indirectly via the motor control, for example, "Configured and adapted" means that the respective component would not only be suitable to satisfy its function in principle, but also satisfies it in operation. Alternatively or additionally, the rotational speed measurement device can comprise a speed sensor that is configured and adapted to directly measure the rotational speed of the rotary drive.

The control device can preferably be configured and adapted to regulate the rotational speed of the rotary drive. The rotational speed measurement device can continuously transmit data to the control device for this purpose. The control device then regulates the rotational speed of the rotary drive by means of the data to the value that has been set for the present operating mode.

In accordance with an advantageous aspect, the control device is configured and adapted to control the feed force of the feed drive. The feed force of the feed drive can hereby be controlled in accordance with a first value up to the switchover point and in accordance with a second value from the switchover point onward. Feed forces of up to 2000 N are preferably settable. The feed drive preferably has an electric motor. To control the feed precisely, a rotational movement produced by the electric motor can be converted into a feed movement via a spindle transmission. The feed drive therefore preferably has an electric motor and a spindle transmission. A feed speed can in this case be calculated by the rotational speed of the electric motor and the pitch of the spindle transmission.

In accordance with an advantageous aspect, a feed force measurement device is provided that is connected to the control device. The feed force measurement device can be configured as a load cell. Alternatively, the feed force measurement device can use the motor current of the feed drive to calculate the feed force of the feed drive.

The control device is advantageously configured and adapted to regulate the feed force of the feed drive. For this purpose, the feed force measurement device can provide the measured data to the control device so that the control device can regulate the feed force in dependence on the measured data.

In accordance with an advantageous aspect, the control device is configured and adapted to control the feed speed of the feed drive. The control device can in particular be configured and adapted to control the feed speed in accordance with a first feed speed up to a switchover point and to control it in accordance with a second feed speed differing from the first feed speed from the switchover point onward.

A feed speed determination device is preferably provided. The feed speed determination device can be provided as a feed speed calculation device by means of which the feed speed of the flow drill can be calculated. The feed speed is preferably calculated with the aid of a measured rotational speed. The feed speed can in particular be calculated with reference to a thread pitch of a spindle transmission and to a rotational speed of an electric motor. The feed speed calculation device is preferably integrated in the control device. The feed speed calculation device can in particular be configured and adapted to continuously calculate the feed speed. The control device can regulate the feed drive in dependence on the calculated instantaneous feed speed such that a maximum feed speed specified by the user for the respective operating mode is not exceeded. Alternatively to this, the feed speed determination device can be configured as a feed speed measurement device by means of which the feed speed is measured. The feed speed measurement device can in particular be configured and adapted to continuously measure the feed speed. The control device can regulate the feed drive in dependence on the measured instantaneous feed speed such that a maximum feed speed specified by the user for the respective operating mode is not exceeded.

In accordance with a preferred aspect, a process duration measurement device is provided. The process duration measurement device is preferably part of the control device. The process duration measurement device can be configured and adapted to measure the process duration of different process stages, i.e. time periods in which a specific operating mode is present, and, for example, to enable the control device to determine an exceeding of a maximum permitted process duration of a process stage. If a maximum process duration of a process stage is exceeded, the control device can be configured and adapted to abort the flow drilling process or to switch to the next process stage, i.e. for example, to the second set of parameters.

The first set of parameters can preferably comprise at least one of the following parameters: feed path, rotational speed, feed force, maximum feed speed, minimal process time, and maximum process time. The first set of parameters can also comprise a plurality of the aforesaid parameters. The first set of parameters can in particular comprise at least three of the aforesaid parameters.

Alternatively or additionally, the second set of parameters can comprise at least one of the following parameters: feed path, rotational speed, feed force, maximum feed speed, minimal process time, and maximum process time. The second set of parameters can preferably comprise a plurality of the aforesaid parameters. The second set of parameters can in particular comprise at least three of the aforesaid parameters.

In accordance with a preferred aspect, the control device is configured and adapted to control the feed drive and/or the rotary drive in accordance with the second set of parameters up to a second defined switchover point and to control it/them in accordance with a third set of parameters differing from the second set of parameters from the second defined switchover point onward. In other words, the control device is configured and adapted to control the feed drive and/or the rotary drive in accordance with at least three different settable operating modes, in particular with exactly three different settable operating modes, during the forming of a flow bore. The first operating mode can, for example, be set during a plasticization and the second operating mode can be set during a forming of a passage. The third operating mode can then, for example, be set during a cutting of a chamfer at the bore.

The third set of parameters can preferably be input by means of the input device. In other words, parameters can be input by means of the input device according to which the flowing drilling apparatus is operated in a third process stage.

Alternatively or additionally, the second switchover point can be able to be input by means of the input device. In other words, a value, for example a feed path, can be able to be input by means of the input device, said value defining the second switchover point.

The display device can be configured and adapted to display the third set of parameters and/or the second switchover point to a user.

In accordance with an advantageous aspect, the third set of parameters comprises at least one of the following parameters: feed path, rotational speed, feed force, maximum feed speed, minimal process time, and maximum process time. The third set of parameters can comprise at least two of the aforesaid parameters. The third set of parameters can in particular comprise three of the aforesaid parameters.

The first set of parameters and the second set of parameters can preferably comprise at least one parameter that is the same. For example, the first set of parameters can comprise a specific rotational speed, for example 4000 r.p.m., and the second set of parameters can comprise a different rotational speed, for example 2000 r.p.m. The third set of parameters can likewise comprise the same parameter, for example a rotational speed of 1500 r.p.m.

The first set of parameters and the second set of parameters can have a plurality of parameters that are the same. For example, the first set of parameters can comprise a specific rotational speed and a specific feed force and the second set of parameters can comprise a different speed and a different feed force. The third set of parameters can likewise comprise a rotational speed and a feed force that can differ from the rotational speed and the feed force of the second set of parameters.

In accordance with an advantageous embodiment, the control device is configured and adapted to control the feed drive and/or the rotary drive up to a switchover point in accordance with a set of parameters that are preset by a manufacturer of the flowing drilling apparatus and that cannot be changed by the customer. It is then not possible for this set of parameters, for example, to adapt the values by means of the input device. Such an operating mode is advantageously used with a preset set of parameters, while the flow drill is moved from a starting position toward a sheet metal part to be machined. If the feed path measurement device determines that the flow drill is almost seated on the sheet metal part, for example in that the feed path measurement device sits on the sheet metal part, the control device can switch over to the first set of parameters selectable by the customer.

The invention additionally relates to a flow drilling process in which a feed drive is controlled to produce a feed of a flow drill in an axial direction and/or in which a rotary drive is controlled to produce a rotational movement of the flow drill in accordance with a first set of parameters up to a defined switchover point and each is controlled in accordance with a second set of parameters differing from the first set of parameters from the defined switchover point onward.

In accordance with a preferred aspect of the flow drilling process, the first set of parameters and/or the second set of parameters is/are input by means of an input device. Alternatively or additionally, geometrical data of the flow drill can be input.

In accordance with a further preferred aspect of the flow drilling process, a switchover point, i.e. a value of a measured variable defining the switchover point, is input by means of the input device.

The first and/or second set of parameters is/are preferably displayed to a user. A display apparatus can be provided for this purpose that is configured as a display, for example. The value of the measured variable defining the switchover point can likewise be displayed.

In accordance with a preferred aspect of the flow drilling process, values of at least one parameter are measured using a measurement device, in particular a sensor. The values measured by the measurement devices can be continuously transmitted to the control device to monitor the parameter.

In accordance with a preferred aspect of the flow drilling process, values of at least two separate parameters are measured by two separate measurement devices, in particular separate sensors. The values measured by the measurement devices can be continuously transmitted to the control device to monitor the parameters.

A feed path of the flow drill is preferably directly or indirectly measured in the flow drilling process. The value of the measured feed path can be continuously transmitted to the control device. For example, the feed path can be measured by means of a differential movement measurement system.

In accordance with an advantageous aspect of the flow drilling process, a rotational speed of the flow drill is directly or indirectly measured. The value of the measured rotational speed can be continuously transmitted to the control device.

The rotational speed of the flow drill can be measured via the motor current, for example. Alternatively to this, the rotational speed of the flow drill can be measured via a separate rotational speed sensor.

In accordance with an advantageous aspect, a feed force that acts on the flow drill is directly or indirectly measured. The measured feed force can then be continuously transmitted to the control device. The feed force is preferably measured by means of a load cell. Alternatively to this, the feed force can be measured by means of the motor current of the feed drive.

In accordance with a preferred aspect, a feed speed of the flow drill is directly or indirectly measured. "Indirectly measured" is to be understood such that a different parameter, for example the rotational speed of the feed motor, is measured and the feed speed is calculated from it. The value of the measured feed speed can be continuously transmitted to the control device.

In addition, a process duration can be measured. The value of the measured process duration can likewise be continuously provided to the control device. It can thus be determined, for example, when a maximum process duration of a process stage has been exceeded. If a maximum process duration of a process stage is exceeded, the flowing drilling apparatus can switch off. Alternatively to this, the flowing drilling apparatus can be regulated by the control device to a second set of parameters, i.e. to a second process stage.

The first set of parameters in accordance with which the flowing drilling apparatus is operated in a first process stage and/or the second set of parameters in accordance with which the flowing drilling apparatus is operated in a second process stage can comprise at least one of the following parameters: feed path, rotational speed, feed force, maximum feed speed, minimal process time, and maximum process time.

In accordance with an advantageous aspect, the control device controls the feed drive and/or the rotary drive in accordance with the second set of parameters up to a second defined switchover point and in accordance with a third set of parameters differing from the second set of parameters from the second defined switchover point onward. In other words, the control device first controls the feed drive and/or the rotary drive in a first operating mode during the drilling process, in a second operating mode from the first switchover point onward, and in accordance with a third operating mode from the second switchover point onward.

In accordance with an advantageous aspect, the third set of parameters is input by means of the input device. Alternatively or additionally, a value that defines the second switchover point can be input by means of the input device.

In accordance with a preferred aspect, the third set of parameters is displayed to a user by means of the display device. Each of the set of parameters is preferably displaced to the user in tabular form so that the values can be compared with one another in a simple manner.

The third set of parameters that define a third operating mode can at least comprise one of the following parameters. feed path, rotational speed, feed force, maximum feed speed, minimal process time, and maximum process time.

Figure 2:
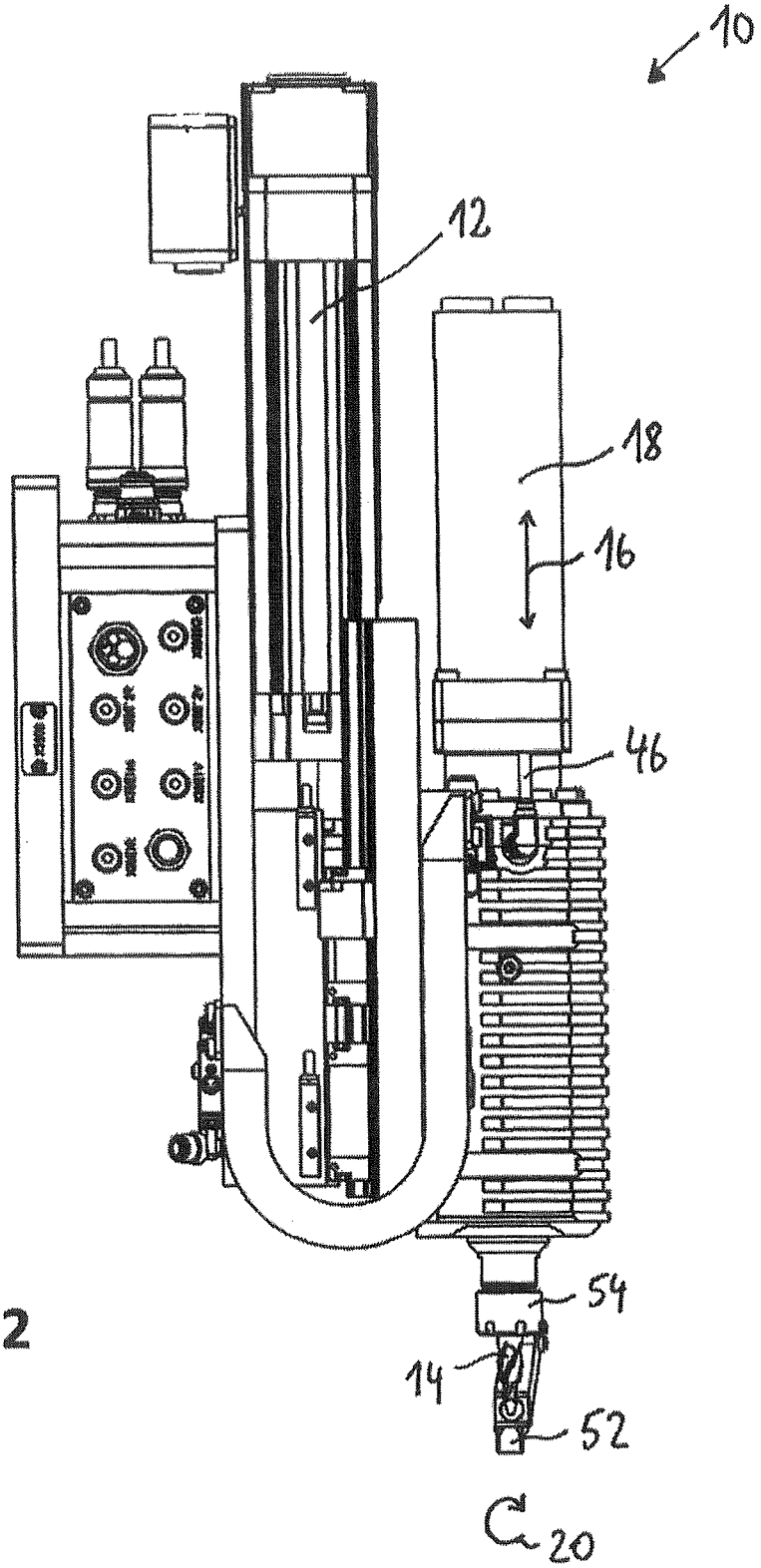
Figure 3:
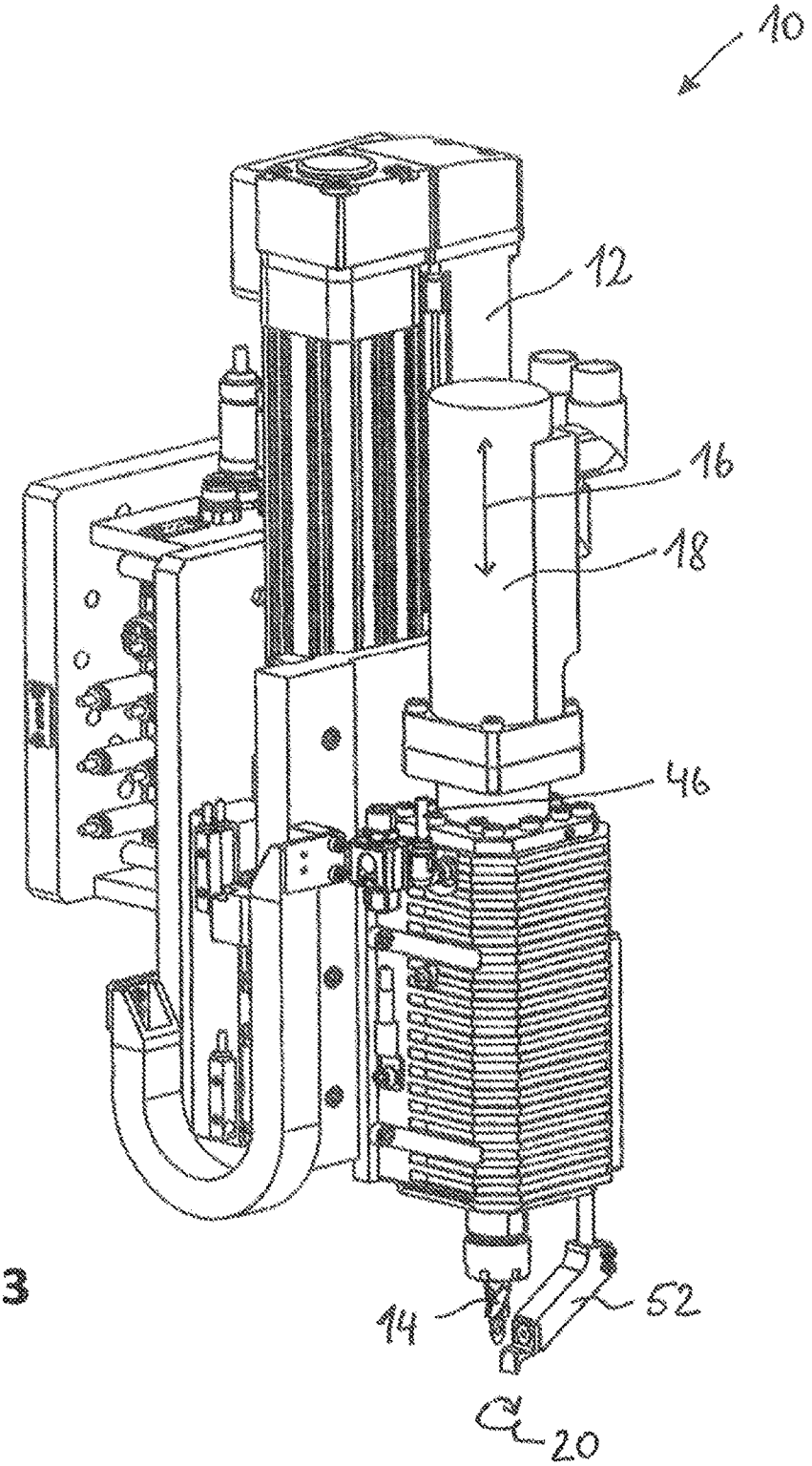
Figure 4:
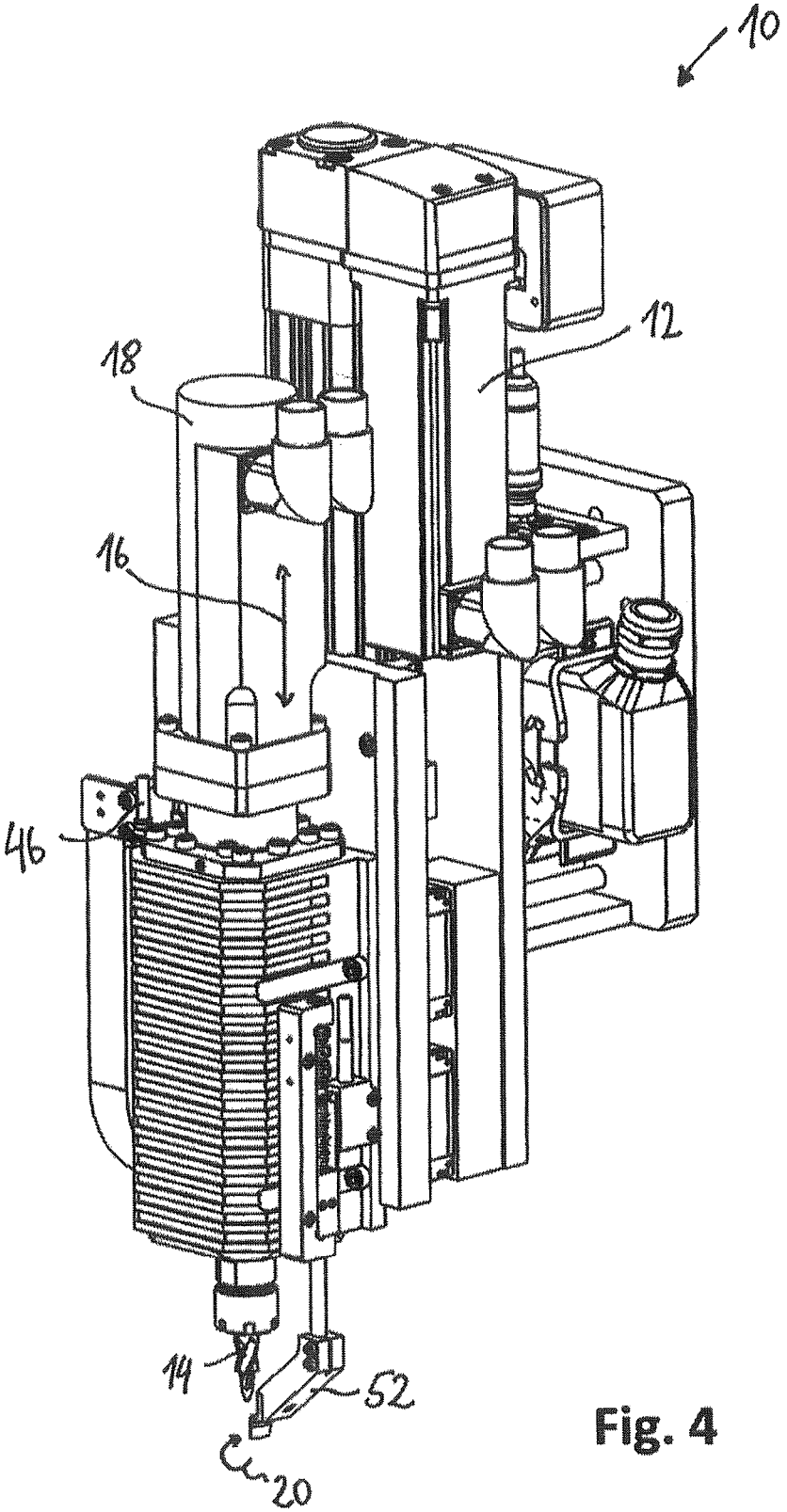
Figure 5:
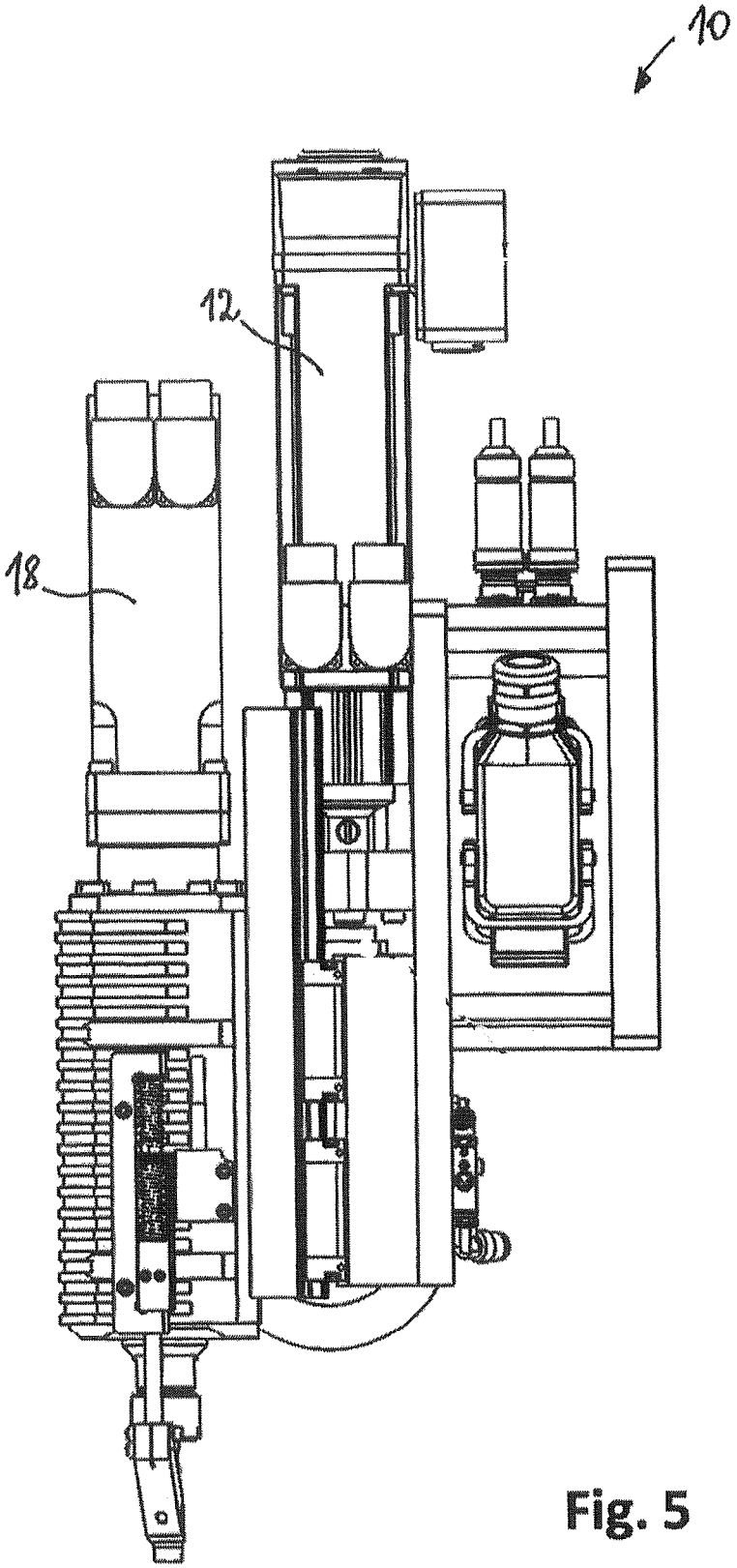
Figure 6:
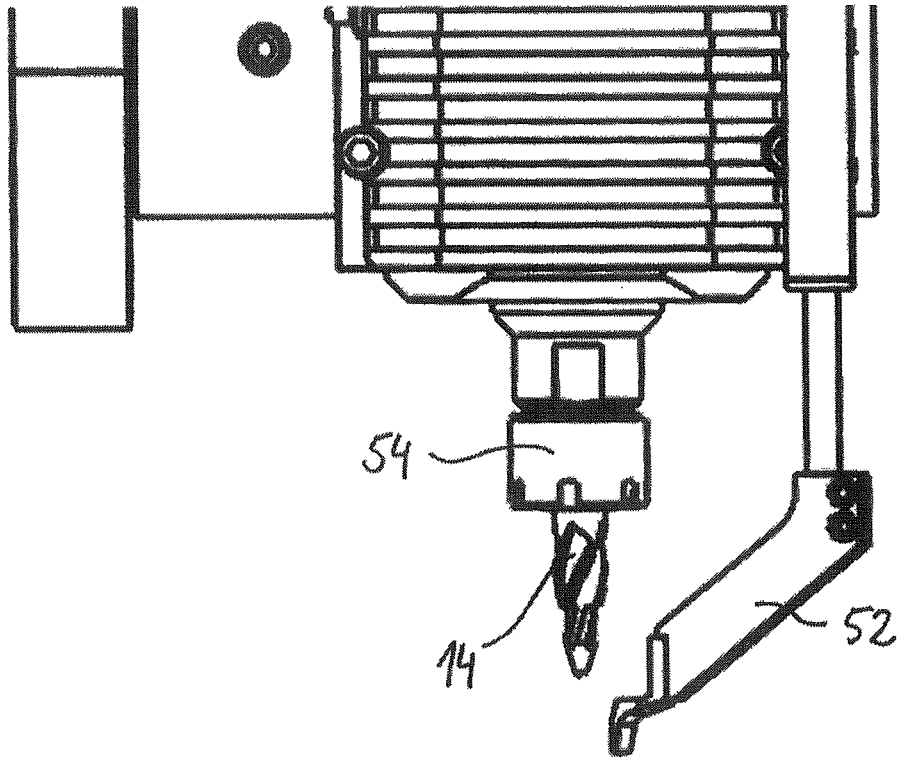
Figure 7:
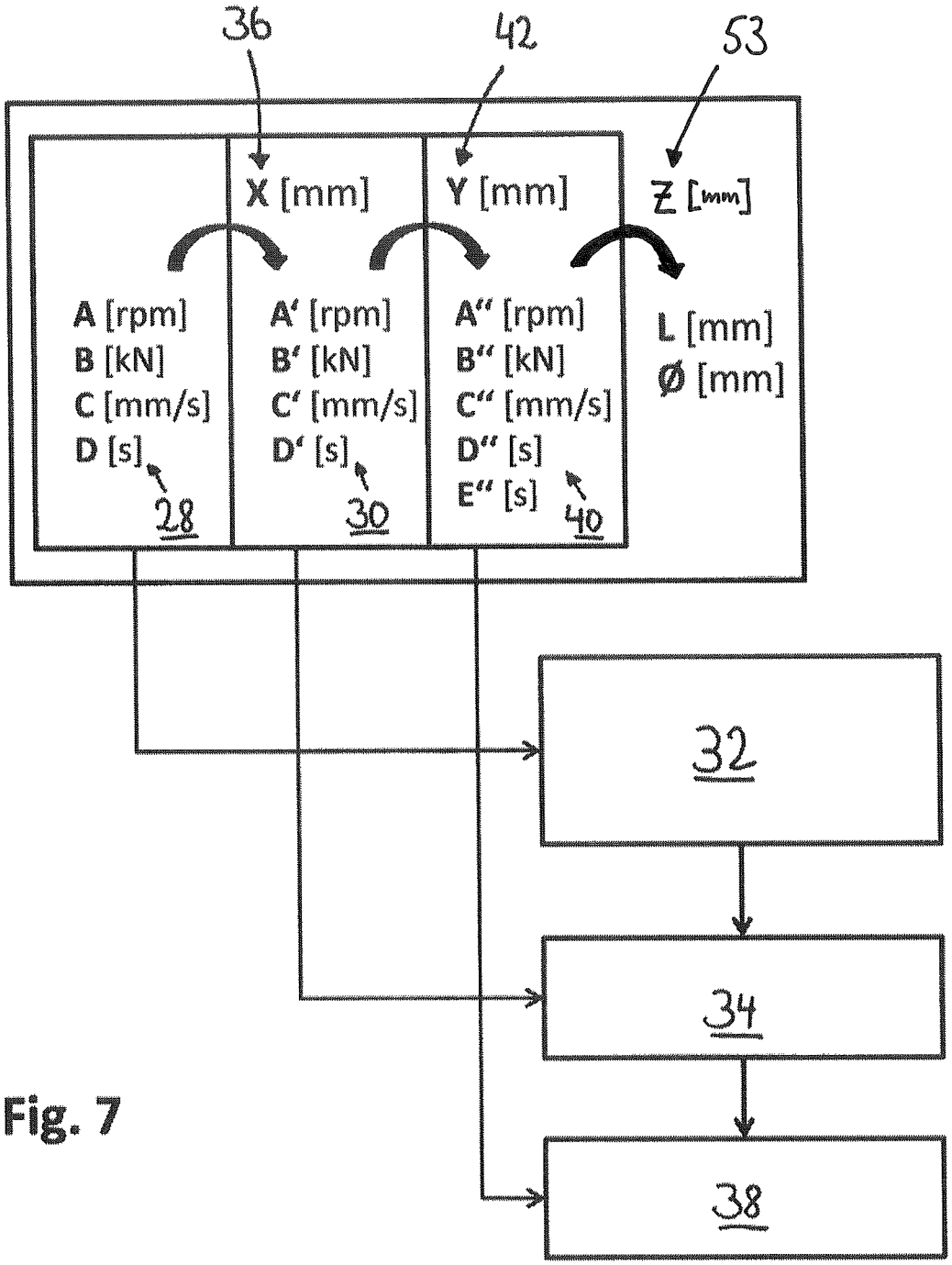

The invention will be described in the following with reference to a purely exemplary embodiment and to the enclosed drawings. There are shown:

FIG. 1 a front view of a flowing drilling apparatus in accordance with the invention;

FIG. 2 a first side view of the flowing drilling apparatus of FIG. 1;

FIG. 3 a first perspective side view of the flowing drilling apparatus of FIG. 1;

FIG. 4 a second perspective side view of the flowing drilling apparatus of FIG. 1, FIG. 5 a second side view of the flowing drilling apparatus of FIG. 1;

FIG. 6 a detail view of the flow drill of the flowing drilling apparatus of FIG. 1; and FIG. 7 a flowchart to describe a control device of the flowing drilling apparatus of FIG. 1.

Different views of a flowing drilling apparatus 10 are shown in FIGS. 1 to 5. The flowing drilling apparatus 10 comprises a feed drive 12 for producing a feed of a flow drill 14 in an axial direction 16. In addition, the flowing drilling apparatus 10 comprises a rotary drive 18 for producing a rotational movement 20 of the flow drill 14.

The flowing drilling apparatus 10 further comprises a control device 22 for controlling the feed drive 12 and the rotary drive 18 in differing operating modes that change during a drilling process. So that a user can individually define the different operating modes, the flowing drilling apparatus 10 has an input device 24, for example an input keypad, and a display device 26, for example a display, that are connected to the control device 22. The input device 24 and the display device 26 can also be formed by a single module such as a touch display. A user can input a first set of parameters 28 and a second set of parameters 30 into the flowing drilling apparatus 10 by means of the input device 24. The first set of parameters 28 here defines a first individually settable operating mode 32 (see FIG. 7). The second set of parameters 30 defines a second individually settable operating mode 34. In addition, the user can define a first individually settable switchover point 36, for example a feed path X, by means of the input device 24, at which the control device 22 switches over from the first operating mode 32 to the second operating mode 34.

In the present example, the first set of parameters 28 comprises a rotational speed A, a feed force B, a maximum feed speed C, and a maximum process stage time D. Each of these parameters A, B, C, and D can be individually input by the user. In addition, the user can input the feed path X that defines how far the flow drill 14 should penetrate into a workpiece, not shown, before the flowing drilling apparatus 10 is to be switched over to the second operating mode 34. In the present case, a specific penetration depth of the flow drill 14 into a workpiece, not shown, thus serves as the switchover point 34, i.e. as the switchover criterion between the first operating mode 32 and the second operating mode 34. The switchover point 34 can be selected, for example, such that a tip of the flow drill 14 exits the workpiece, a metal sheet as a rule, at the switchover point 14.

The second set of parameters 30 is preferably selected such that the rotational speed A' in the second operating mode 34 is smaller than the rotational speed A of the first operating mode 32. In addition, the feed force B' of the second operating mode 34 should be selected as smaller than the feed force B in the first operating mode 32. It is recommended also to select the maximum feed speed C' of the second operating mode as smaller than the maximum feed speed C of the first operating mode. A better surface quality of the passage is hereby achieved. The maximum permitted process stage time D' of the second operating mode 34 can also be defined as shorter with respect to the maximum permitted process stage time of the first operating mode 32.

In addition, as shown in FIG. 7, the control device 22 can be configured and adapted to control the feed drive 12 and the rotary drive 18 in accordance with a third operating mode 38. In this case, the user defines a third set of parameters 40 and a second switchover point 42 via the input device 24. To check the input, the third set of parameters 40 and the second switchover point 42 as well as the first set of parameters 28, the second set of parameters 30, and the first switchover point 36 can be displayed to the user via the display device 26. As likewise shown in FIG. 7, a length L and/or a diameter Ø of the flow drill can be able to be input by means of the input device 24 and can be displayed by means of the display device 26.

To be able to regulate the rotary drive 18 to a specific rotational speed and thus to operate it in accordance with the specified rotational speeds A, A', and A" of the different operating modes, the flowing drilling apparatus 10 comprises a rotational speed measurement device 44 integrated in the rotary drive 18. The rotational speed measurement device 44 is connected to the control device 22 so that the control device 22 always provides the current rotational speed of the flow drill 14. The control device 22 can regulate the rotational speed of the flow drill 14 in accordance with the predefined rotational speeds A, A', or A" by means of these data.

To be able to regulate the feed drive 12 to a specific feed force and thus to operate it in accordance with the specified feed forces B, B', or B" of the different operating modes, the flowing drilling apparatus 10 has a feed force measurement device 46 in the form of a load cell. The feed force measurement device 46 transmits the measured data to the control device 22 so that the latter can regulate the feed drive 12 to the respective specified feed force B, B', or B".

As can be seen in FIG. 1, the flowing drilling apparatus 10 additionally comprises a feed sped determination device 48, here in the form of a feed speed calculation device. The feed speed calculation device 48 calculates the current feed speed of the flow drill 14 and provides the calculated data to the control device 22. The control device 22 monitors that the maximum feed speed C. C'. or C" of the currently present operating mode 32, 34, or 38 is not exceeded.

As can likewise be seen in FIG. 1, the flowing drilling apparatus 10 additionally comprises a process duration measurement device 50. The process duration measurement device 50 is part of the control device 22. The process duration measurement device 50 is configured and adapted to measure the process duration of each process stage and to provide the process duration for the control of the flowing drilling apparatus 10. The control device 22 determines whether a maximum process stage duration D, D', or D" of the respective process stage has been reached with reference to the data produced by the process duration measurement device 50. If the maximum process stage duration D, D', or D" has been reached, either the flowing drilling apparatus 10 can be switched off or a change can be made to the next process stage, i.e. to the next set of parameters.

As can be seen in FIG. 1, for example, the flowing drilling apparatus 10 additionally comprises a feed path measurement device 52 that lies on the workpiece, not shown, during the operating modes 32, 34, and 38. This makes it possible to measure the axial feed path of the flow drill 14 relative to the workpiece, not shown. The feed path measurement device 52 serves to determine whether a switchover to a different operating mode has to be made. For this purpose, the feed path measurement device 52 continuously transmits data to the control device 22 that then determines whether the next switchover criterion, i.e. the switchover point 36 or 42, has already been reached. If the switchover point 36, 42 has been reached, the control device 22 switches over to the next operating mode 34, 38. A switch-off point or a switch-off criterion 53 (FIG. 7) can be defined after the last operating mode. The feed path measurement device 52 preferably here also determines whether the switch-off point 53 has been reached. In other words, a specific path can serve as the switch-off criterion 53. If the switch-off criterion 53 has been reached, the process is ended.

A detail view of the flow drill 14 and of a clamping apparatus 54 for the flow drill 14 is shown in FIG. 6. The clamping apparatus 54 is configured as a collet chuck to simplify the tool change between different flow drills.

As a rule, the flow drill 14 first has to be moved toward the surface of a workpiece to be machined in flow drilling. During this operating mode, not shown, so-to-say the zeroth operating mode, the flowing drilling apparatus 10 is controlled using preset parameters fixed by the manufacturer. The flowing drilling apparatus 10 is, for example, operated with a preset feed and at a preset rotational speed until the feed path measurement device 52 detects that the flow drill 14 is just in front of the workpiece. This can be detected in that the feed path measurement device 52 contacts the workpiece. As soon as such a state is detected, the control device 22 can switch over the flowing drilling apparatus 10 to the first operating mode 32.

When the tip of the flow drill 14 exits the workpiece again, the flowing drilling apparatus 10 should switch over to the second operating mode 34 to shape the passage at a lower rotational speed A' and with a lower feed force B'. The first switchover point 36 should therefore be selected such that the plasticization takes place during the first operating mode 32, but the shaping of the passage is carried out in the second operating mode 34. When the passage has been shaped, the flowing drilling apparatus 10 should switch over to the third operating mode 38 to, for example, form a chamfer at the flow hole. The second switchover point 42 should therefore be selected such that the flowing drilling apparatus 10 switches over when the passage has been completely shaped and the hole should now be chamfered. At the end of the process, a switch-off point 53 should be defined at which the flowing drilling apparatus automatically switches off. A predefined feed path can likewise serve as the switch-off point 53.

REFERENCE NUMERAL LIST

10 flowing drilling apparatus
12 feed drive
14 flow drill
16 axial direction
18 rotary drive
20 rotational movement
22 control device
24 input device
26 display device
28 first set of parameters
30 second set of parameters
32 first operating mode
34 second operating mode
36 first switchover point
38 third operating mode
40 third set of parameters
42 second switchover point
44 rotational speed measurement device
46 feed force measurement device
48 feed speed determination device
50 process duration measurement device
52 feed path measurement device
53 switch-off point
54 clamping apparatus
A rotational speed
B feed force
C maximum feed speed
D maximum process stage duration
E minimal process stage duration

The invention claimed is:

1. A flowing drilling apparatus, comprising:

a feed motor drive for producing a feed of a flow drill in an axial direction to selectively place the flow drill in contact with a workpiece;

a rotary motor drive for producing a rotational movement of the flow drill, and a control switch device that is configured and adapted to control at least one of the feed drive and the rotary drive in accordance with a first set of parameters up to a defined switchover point and to control at least one of the feed drive and the rotary drive in accordance with a second set of parameters differing from the first set of parameters from the defined switchover point onward, wherein the flow drill when operated under the first set of parameters plasticizes a portion of material of the workpiece, and the flow drill when operated under the second set of parameters shapes the portion of material of the workpiece.

2. The flowing drilling apparatus in accordance with claim 1, wherein a second set of parameters differs from the first set of parameters with respect to its values.

3. The flowing drilling apparatus in accordance with claim 1, further comprising an input device of which at least one of the first set of parameters and the second set of parameters can be input.

4. The flowing drilling apparatus in accordance with claim 1, farther comprising an input device of which the switchover point can be input.

5. The flowing drilling apparatus in accordance with claim 1, further comprising a display device of which at least one of the first set of parameters and the second set of parameters can be displayed to a user.

6. The flowing drilling apparatus in accordance with claim 1, wherein the control device is connected to at least two separate measurement devices for monitoring a respective parameter.

7. The flowing drilling apparatus in accordance with claim 1, further comprising a feed path measurement device that is connected to the control device.

8. The flowing drilling apparatus in accordance with claim 1, wherein the control device is configured and adapted to control a rotational speed of the rotary drive.

9. The flowing drilling apparatus in accordance with claim 1, further comprising a rotational speed measurement device that is connected to the control device.

10. The flowing drilling apparatus in accordance with claim 1, wherein the control device is configured and adapted to control a feed force of the feed drive.

11. The flowing drilling apparatus in accordance with claim 1, further comprising a feed force measurement device that is connected to the control device.

12. The flowing drilling apparatus in accordance with claim 1, wherein the control device is configured and adapted to control a feed speed of the feed drive.

13. The flowing drilling apparatus in accordance with claim 1, further comprising a feed speed transmitter determination device that is configured and adapted to transmit determined speed data to the control device.

14. The flowing drilling apparatus in accordance with claim 1, further comprising a process duration transmitter measurement device that is configured and adapted to transmit the process duration of an operating mode to the control device.

15. The flowing drilling apparatus in accordance with claim 1, wherein the first set of parameters comprises at least one of following parameters: feed path, rotational speed, feed force, maximum feed speed, minimal process time, maximum process time.

16. The flowing drilling apparatus in accordance with claim 1, wherein the second set of parameters comprises at least one of following parameters: feed path, rotational speed, feed force, maximum feed speed, minimal process time, maximum process time.

17. The flowing drilling apparatus in accordance with claim 1, wherein the control device is configured and adapted to control at least one of the feed drive and the rotary drive in accordance with the second set of parameters up to second defined switchover point and to control at least one of the feed drive and the rotary drive in accordance with a third set of parameters differing from the second set of parameters from the second defined switchover point onward.

18. The flowing drilling apparatus in accordance with claim 1, wherein the first set of parameters and the second set of parameters have at least two parameters that are same.

19. A flow drilling process, the flow drilling process comprising steps of:

controlling at least one of a feed motor drive to produce a feed of a flow drill in an axial direction to selectively contact a workpiece with the flow drill and a rotary motor drive to produce a rotational movement of the flow drill up to a defined switchover point in accordance with a first set of parameters, and controlling the at least one of the feed drive and the rotary drive from the defined switchover point onward in accordance with a second set of parameters differing from the first set of parameters, wherein the flow drill when operated under the first set of parameters plasticizes a portion of material of the workpiece, and the flow drill when operated under the second set of parameters shapes the portion of material of the workpiece.

20. The flow drilling process in accordance with claim 19, wherein at least one of the first set of parameters and the second set of parameters is input to an input device.

* * * * *